US011219871B2

(12) United States Patent
Simone

(10) Patent No.: US 11,219,871 B2
(45) Date of Patent: Jan. 11, 2022

(54) LIQUID DIFFUSING FILTER

(71) Applicant: Pronto Concepts Inc., San Franscico, CA (US)

(72) Inventor: Alexander Simone, San Francisco, CA (US)

( * ) Notice: Subject to any disclaimer, the term of this patent is extended or adjusted under 35 U.S.C. 154(b) by 494 days.

(21) Appl. No.: 15/917,630

(22) Filed: Mar. 10, 2018

(65) Prior Publication Data

US 2018/0257045 A1 Sep. 13, 2018

Related U.S. Application Data

(60) Provisional application No. 62/469,715, filed on Mar. 10, 2017.

(51) Int. Cl.
*B01F 3/04* (2006.01)
*B01F 5/06* (2006.01)
*B01F 13/00* (2006.01)

(52) U.S. Cl.
CPC ..... *B01F 3/04241* (2013.01); *B01F 3/04751* (2013.01); *B01F 5/0655* (2013.01); *B01F 13/0033* (2013.01); *B01F 2003/04319* (2013.01); *B01F 2215/0072* (2013.01)

(58) Field of Classification Search
CPC .... B01F 2215/0072; B01F 2003/04319; B01F 3/04751; B01F 13/0033; B01F 5/0655; B01F 3/04241
See application file for complete search history.

(56) References Cited

U.S. PATENT DOCUMENTS 3,398,836 A * 8/1968 Hugentobler ..... A47J 31/0631 210/455
5,293,912 A * 3/1994 Wildash ..... A47G 23/00 141/106
5,713,263 A * 2/1998 Burks, III ..... B01F 3/0446 99/277.2
6,508,163 B1 * 1/2003 Weatherill ..... A47G 23/00 261/112.1
6,568,660 B1 * 5/2003 Flanbaum ..... B65D 47/06 222/189.07
D605,465 S * 12/2009 Benton ..... D7/396.2
8,101,222 B2 * 1/2012 Burroughs ..... A47G 19/2205 426/474
D660,078 S * 5/2012 Kehoe ..... D7/397
8,196,906 B2 * 6/2012 Benton ..... B01F 3/0473 261/110
8,413,858 B2 * 4/2013 Rasmussen ..... B65D 25/40 222/565
8,430,023 B2 * 4/2013 Hynes ..... B01F 3/04751 99/323.1
D681,393 S * 5/2013 Agarwal ..... D7/398
8,727,324 B2 * 5/2014 Borden ..... B01F 5/0428 261/76
8,757,048 B2 * 6/2014 Burroughs ..... B01F 3/04099 99/277.1

(Continued)

*Primary Examiner* — Stephen Hobson
(74) *Attorney, Agent, or Firm* — Invention To Patent Services; Alex Hobson

(57) ABSTRACT

A liquid-diffusing filter which can aerate a liquid by diffusing it and thus exposing it to air to oxygenate the liquid. The user can pour a liquid through the device and it comes out diffused. Thus a superior liquid aerating solution is provided that can more simply aerate a beverage.

3 Claims, 4 Drawing Sheets

(56) References Cited

U.S. PATENT DOCUMENTS 8,875,753 B2 * 11/2014 Norris ..... A47G 21/00 141/333
8,894,042 B2 * 11/2014 Kilduff ..... A47G 19/2205 261/4
8,925,443 B2 * 1/2015 Agarwal ..... B01F 13/002 99/323.1
9,283,526 B2 * 3/2016 Smith ..... B65D 1/023
9,321,019 B2 * 4/2016 Stevenson ..... B01F 3/04106
9,719,061 B2 * 8/2017 Buzzard ..... B01F 3/04787
9,938,491 B2 * 4/2018 Castanon Delgado ..... B01F 3/04744
10,220,357 B1 * 3/2019 Hsueh ..... B01F 7/00916
10,500,552 B1 * 12/2019 Liu ..... B01F 3/04794
10,603,643 B2 * 3/2020 Baig ..... B01F 3/0446
2010/0025867 A1 * 2/2010 Benton ..... B01F 3/0473 261/110
2010/0124594 A1 * 5/2010 Burroughs ..... A47G 19/2205 426/474
2011/0271846 A1 * 11/2011 Hynes ..... B01F 3/04751 99/323.1
2011/0297001 A1 * 12/2011 DeJohn ..... C12H 1/14 99/277.2
2012/0201942 A1 * 8/2012 Kilduff ..... B01F 3/04751 426/474
2012/0261844 A1 * 10/2012 Lei ..... B01F 3/04751 261/119.1
2015/0021794 A1 * 1/2015 Zhou ..... B01F 3/04503 261/8
2016/0271574 A1 * 9/2016 Buzzard ..... C12H 1/14
2016/0339398 A1 * 11/2016 Stevenson ..... B01F 3/04794
2017/0304783 A1 * 10/2017 Gupta ..... B01F 5/0656
2018/0250643 A1 * 9/2018 Benati ..... B01F 3/04787
2018/0311628 A1 * 11/2018 Lu ..... B01F 13/0022
2019/0060847 A1 * 2/2019 Liu ..... B01F 3/04751
2019/0366279 A1 * 12/2019 Liu ..... B01F 3/04794
2020/0269198 A1 * 8/2020 Stevenson ..... B01F 3/0412

* cited by examiner

LIQUID DIFFUSING FILTER

CROSS-REFERENCE TO RELATED APPLICATIONS

This application claims the benefit of U.S. Provisional Application No. 62/469,715, filed Mar. 10, 2017, which is incorporated herein by reference.

BACKGROUND

Certain beverages can experience improved taste by defusing the liquid to maximize exposure to surrounding oxygen. Preexisting methods infuse oxygen tunneled in through side holes or spread the liquid across a large surface area. These devices often require users to carefully regulate their pouring speed to avoid overflow or spillage of the liquid. The design of these devices are often complex and make cleaning/maintenance difficult.

SUMMARY

In one aspect, methods and filters are provided to diffuse liquid passing through to allow a liquid to mix with oxygen. In some variations, a liquid-diffusing filter is described that can be configured to aerate a liquid when poured through the liquid-diffusing filter. The liquid-diffusing filter can include a housing 1. The housing 1 can have a fill hole 2 and an exit hole 7. The fill hole 2 can be configured to facilitate the pouring of a liquid into the liquid-diffusing filter. The housing 1 can include a vessel engaging portion 6. The vessel engaging portion 6, can be proportioned to fit the top of a drinking vessel. The drinking vessel can be, for example, a wine glass 11 or other related apparatus.

In some variations, the filter can be configured to have one or more apertures 4 to facilitate the flow of liquid through the liquid-diffusing filter. In some variations, the apertures can facilitate flow of liquid in multiple streams 10. The multiple streams can increase the surface area of the liquid as it flows through the liquid-diffusing filter to increase exposure to air and thereby oxygenate the liquid.

In some variations, the apertures 4 can be arranged at a series of levels 5.

The liquid-diffusing filter housing 1 can include a fill hole 2. The fill hole 2 can be configured to allow liquid to be easily poured into the liquid-diffusing filter.

The liquid-diffusing filter can include an exit hole 7. The exit hole 7 can be configured to allow liquid to easily flow out of the liquid-diffusing filter.

The liquid-diffusing filter can include vessel engaging portion 6 configured to fit on top of drinking glasses or other apparatus.

Some non-limiting advantages of the presently described liquid-diffusing filter can include a simplified solution for quickly aerating or oxygenating a beverage. Some beverages are enjoyed more appropriately when exposed to oxygen.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
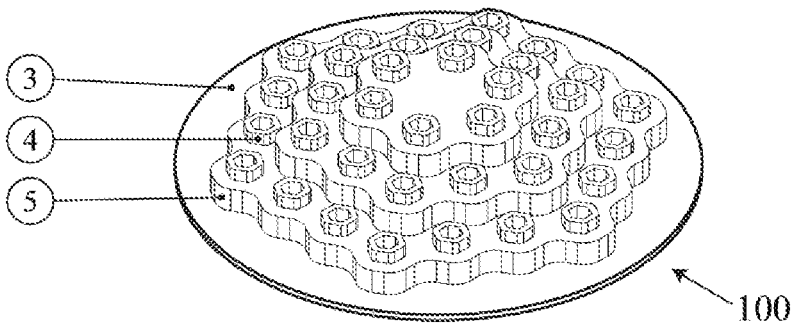
FIG. 1 is a perspective view of one embodiment of a liquid-diffusing filter having one or more features consistent with the present description.

FIG. 1 is a perspective view of an example of a liquid-diffusing filter 100 having one or more features consistent with the present description. The liquid-diffusing filter 100 can include one or more apertures 4. The one or more apertures 4 can facilitate separation of the liquid poured through the filter 100, into one or more streams. In some variations, the liquid-diffusing filter 100 can include a plurality of apertures 4 arranged into multiple levels 5. The apertures being arranged into multiple levels 5 can facilitate separation of the multiple streams of liquid. The apertures 4 being arranged into multiple levels 4 can avoid the streams merging. Merging of the streams reduces the surface area of the liquid exposed to air and thereby reduced the oxygenation of the liquid.

The liquid-diffusing filter 100 can be formed from one or more of metal, plastic, a polymer, or the like. In some variations, the filter 100 can be made with an injection mold, cut with a laser, or pressed from a sheet of metal.

Figure 2:
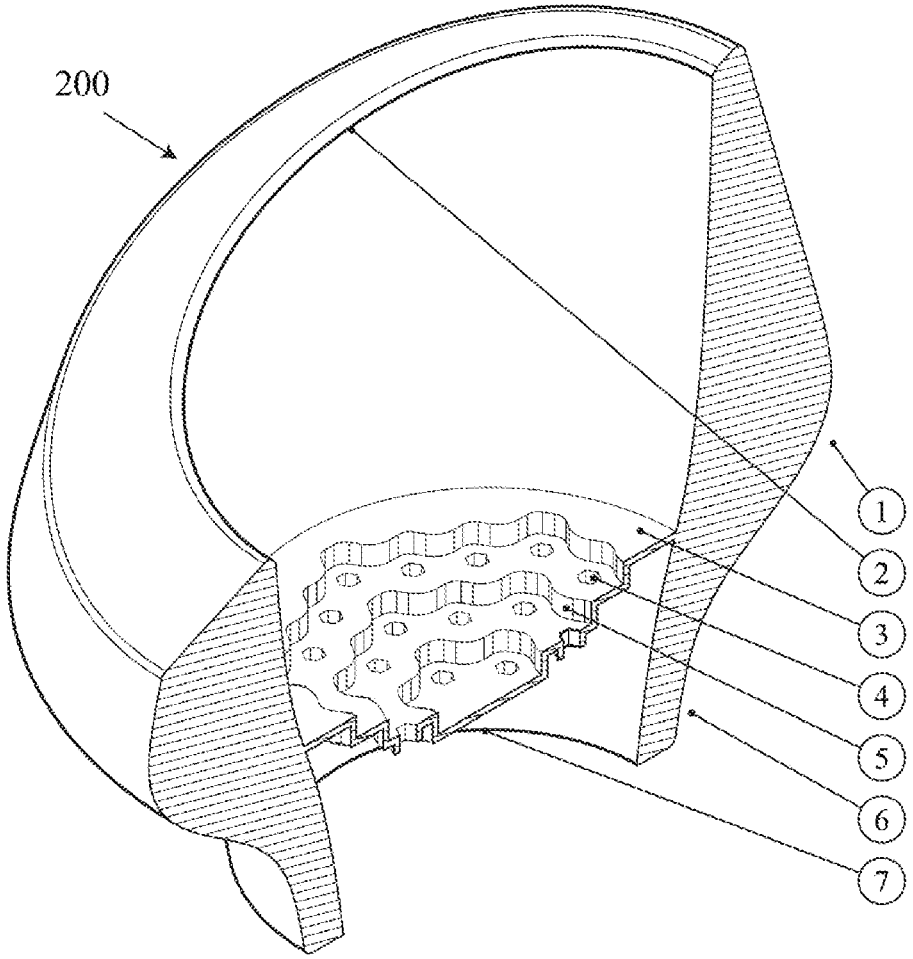
FIG. 2 is a cross-sectional perspective view of another embodiment of a liquid-diffusing filter having a housing surrounding the liquid-diffusing filter shown in FIG. 1.

FIG. 2 is cross-sectional perspective view of a housing 200 surrounding the filter 100 shown in FIG. 1 having one or more features consistent with the present description. The housing 200 can include a fill hole 2 to allow a user to pour a liquid into the housing 200. The liquid-diffusing filter exterior 1 can include a vessel engagement portion 6 configured to engage with a vessel. In some variations, the vessel engagement portion 6 can be configured to fit on top of a drinking glass. The housing 200 can include an exit hole 7 for the liquid to flow out of the device.

The liquid-diffusing filter 100 and the housing 200 can be formed of different materials. In some variations, the liquid-diffusing filter 100 and the housing 200 can be formed contiguously. In some variations, the liquid-diffusing filter 100 can be formed separately from the same material.

The vessel engagement portion 6 can be configured to fit on top of a drinking glass, for example, a wine glass 11, to aid the pouring process.

The liquid-diffusing filter 100 and the housing 200 can take the form of any shape and the figures are not intended to be limiting.

Figure 3:
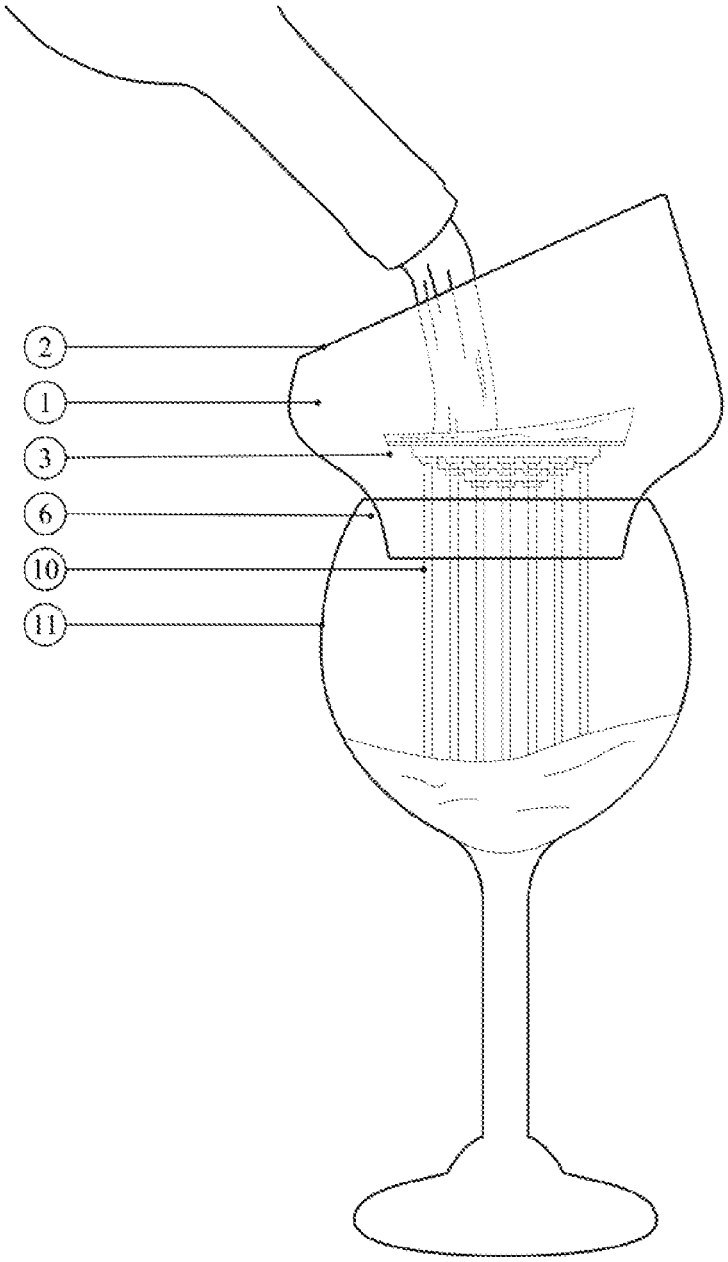
FIG. 3 shows a side view of the liquid-diffusing filter in use, secured on top of a wine glass.

FIG. 3 shows a side view of an example of a liquid-diffusing filter 100 and the housing 200 in use and engaged with a top of a drinking glass having one or more features consistent with the present description. This example shows one use of the liquid-diffusing filter where liquid is being poured from the top, passing through the liquid-diffusing filter 100 and pouring out into a glass 11.

The apertures 4 facilitate separation of the introduced liquid into streams 10. The liquid being separated into streams increases the overall surface area of the liquid exposed to air. Increasing exposure to air increases the oxygenation of the liquid.

The apertures 4 can be arranged at different levels 5 (as illustrated in FIG. 2). The apertures 4 being arranged at different levels 5 can facilitate maintaining stream separation of the liquid when the liquid is poured through the liquid-diffusing filter 100. The apertures 4 arranged at different levels 5 can facilitate separation of the streams when the liquid-diffusing filter 100 is used at an angle to the direction of gravity.

The multiple levels 5 allows for the increased number of apertures 4 while maintaining separation of the streams. An increased number of separate streams facilitate quicker traversal of the liquid through the liquid-diffusing filter. For example, the increased number of apertures can facilitate a user to pour wine, from a wine bottle, through the liquid-diffusing filter 100 without risk of overflow or spillage.

In some variations, the apertures 4 can be tubes. Having the apertures 4 being tubes can facilitate avoidance of stream diversion as the liquid flows through the apertures 4. In some variations, the tubes can be contracting tubes, whereby the radius of the tube is smaller toward the exit hole 7 compared to the entry hole 2. In some variations, the tubes can have graduating radii. While the term "radius" is used, this is not intended to limit the tubes to being round. The tubes can have any shape, such as irregular or regular polygonal shape, oval, round, or the like.

The liquid-diffusing filter 100 and its components can have any size, in some exemplary embodiments the base plate 3 can have a width in the range of 3 cm to 10 cm, and the apertures 4 of the liquid-diffusing filter 100 can have a width in the range of 0.1 cm to 0.5 cm. In some variations, the apertures 4 can have a height in the range of 0.05 cm to 0.3 cm. In some exemplary embodiments there can be between 6-60 apertures 4. The levels 5 of the liquid-diffusing filter 100 can have a height in the range of 0.1 cm to 0.5 cm. The levels 5 of the liquid diffusing filter 100 can have a size relative to the size of the liquid diffusing filter 100. For example, the levels 5 of a large liquid diffusing filter 100 can have a size up to 1.3 cm.

The liquid-diffusing filter housing 200 and its components can have any size; in some exemplary embodiments it can have a height between 3 cm to 15 cm and a width of 3 cm to 15 cm. The vessel engagement portion 6 can have a width between 3 cm and 10 cm.

Figure 4:
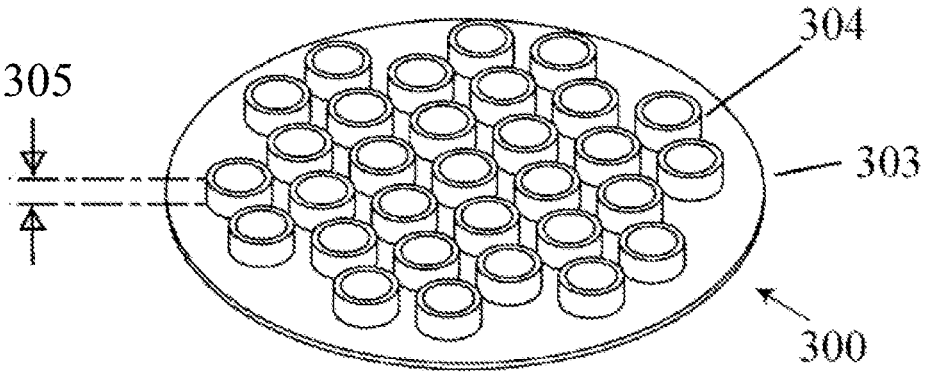
FIG. 4 is a perspective view of another embodiment of a liquid-diffusing filter having one or more features consistent with the present description.

FIG. 4 is a perspective view of another embodiment of a liquid-diffusing filter 300 having one or more features consistent with the present description. The liquid-diffusing filter 300 includes a base plate 303 having multiple apertures 304. The apertures 304 can facilitate separation of the liquid poured through the filter 300, into one or more streams (see FIG. 6). The apertures 304 are spaced apart a sufficient distance from adjacent apertures 304 to avoid the streams merging when poured. Merging of the streams reduces the surface area of the liquid exposed to air and thereby reduced the oxygenation of the liquid.

In some variations, the apertures 304 have a height 305 from the base 303 forming tubes having an axis. In some variations, the tubes can be contracting tubes, whereby the radius of the tube is smaller toward the exit hole compared to the entry hole. In some variations, the tubes can have graduating radii. While the term "radius" is used, this is not intended to limit the tubes to being round. The tubes can have any shape, such as irregular or regular polygonal shape, oval, round, or the like.

The apertures 304 may be the same height 305 or may be arranged at different heights 305 to facilitate maintaining stream separation of the liquid when the liquid is poured through the liquid-diffusing filter 300. The different heights 305 may be arranged to facilitate separation of the streams when the liquid-diffusing filter 300 is used at an angle to the direction of gravity. The different heights 305 may be arranged randomly or arranged in a pattern or design. In some embodiments the apertures 304 axis may be parallel, so the stream flows parallel. In some embodiments, the apertures 304 axis are non-parallel so the streams are non-parallel. For example, the apertures 304 axis may be angled such that the stream has a spin or twist flow.

The liquid-diffusing filter 300 can be formed from one or more of metal, plastic, a polymer, or the like. In some variations, the filter 300 can be made with an injection mold, cut with a laser, or pressed from a sheet of metal.

Figure 5:
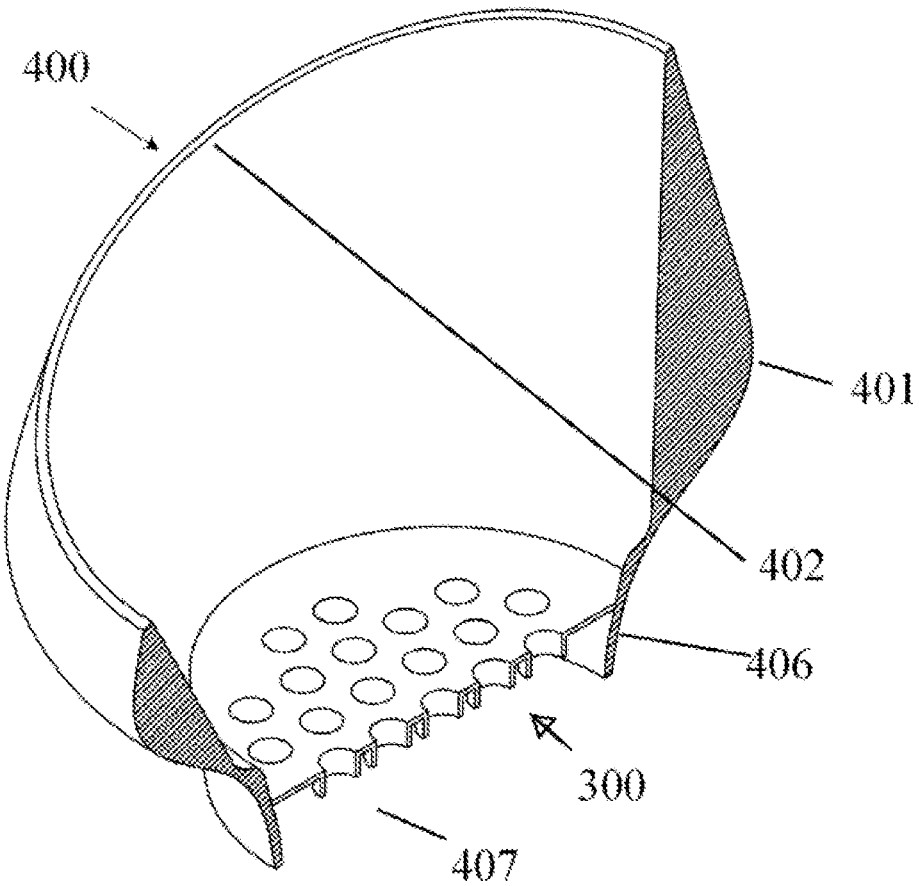
FIG. 5 is a cross-sectional perspective view of another embodiment of a liquid-diffusing filter having a housing surrounding the liquid-diffusing filter shown in FIG. 4.

FIG. 5 is cross-sectional perspective view showing another embodiment of a liquid-diffusing filter 400 having a housing 401 coupled with filter 300 shown in FIG. 4 having one or more features consistent with the present description. The housing 401 includes a fill hole 402 to allow a user to pour a liquid into the liquid-diffusing filter 400. The liquid-diffusing filter exterior can include a vessel engagement portion 406 configured to engage with a vessel. In some variations, the vessel engagement portion 406 can be configured to fit on top of a drinking glass for example, a wine glass 411, to aid the pouring process. In other variations, the engagement portion 406 may have a threaded portion configured to couple with other types of vessels, such as a thermos. In other variations, the engagement portion 406 may have latches or other coupling means. The housing 400 can include an exit hole 407 for the liquid to flow out of the device.

The housing 401 and filter 300 can be formed of different materials. In some variations, the housing 401 and liquid-diffusing filter 300 and can be formed contiguously. In some variations, the housing 401 and filter 300 can be formed separately from the same material.

The liquid-diffusing filter 401 and filter 300 can take the form of any shape and the figures are not intended to be limiting.

Figure 6:
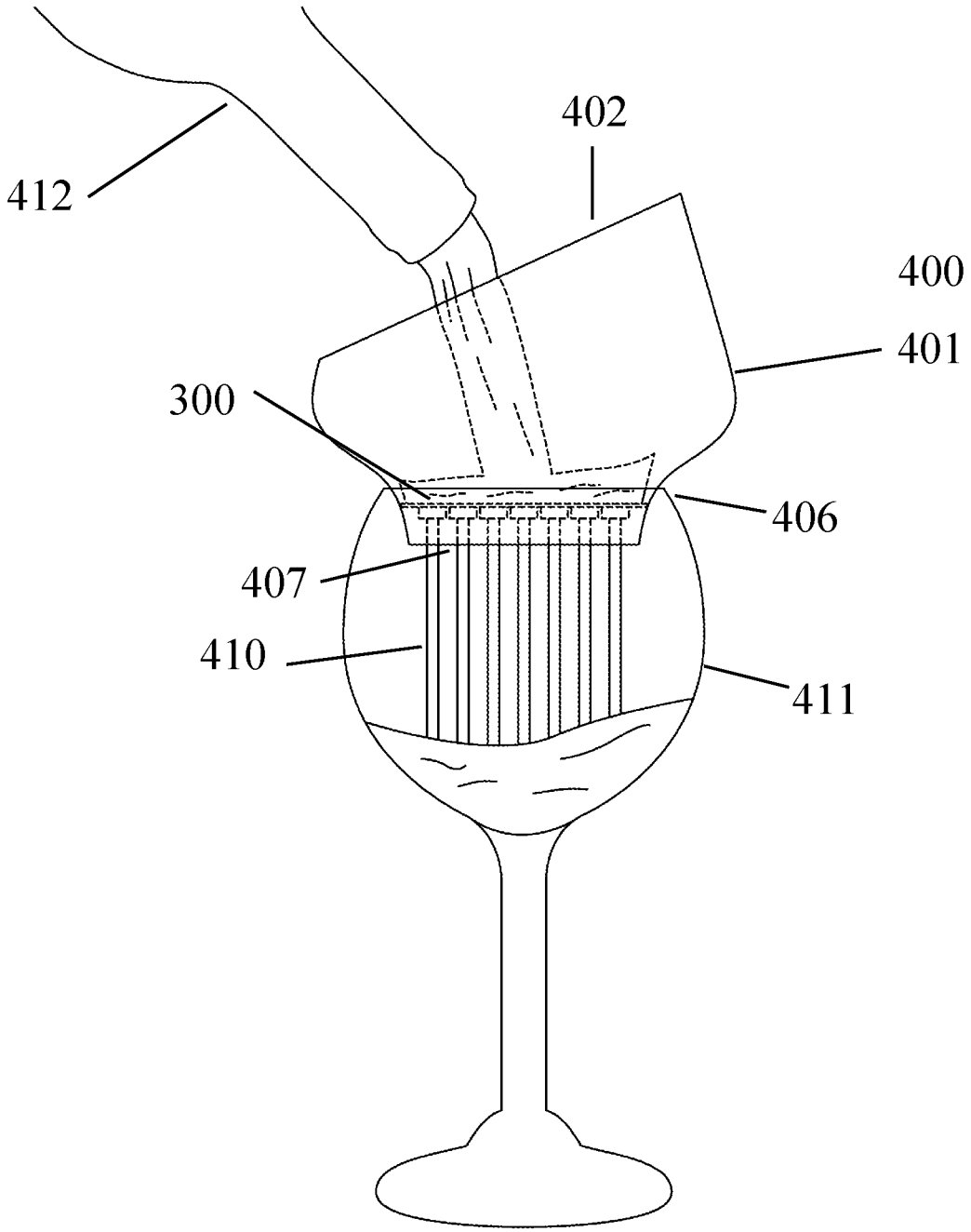
FIG. 6 shows a side view of the liquid-diffusing filter in use, secured on top of a wine glass.

FIG. 6 shows a side view of the liquid-diffusing filter 400 in use and engaged with a top of a drinking glass 411 having one or more features consistent with the present description. This example shows one use of the liquid-diffusing filter 400 where liquid is being poured from the top 402 of housing 400, passing through the apertures 304 of the liquid-diffusing filter 300 and pouring out into a glass 411.

As discussed above, the apertures 304 facilitate separation of the introduced liquid into streams 410. The liquid being separated into streams increases the overall surface area of the liquid exposed to air. Increasing exposure to air increases the oxygenation of the liquid.

The apertures 304 being arranged at a spacing to facilitate maintaining stream separation of the liquid when the liquid is poured through the liquid-diffusing filter. The apertures 304 may also be may be the same height or length 305 or may be different heights or lengths for separation of the streams. The may be advantageous when the liquid-diffusing filter 400 is used at an angle to the direction of gravity.

The multiple lengths 305 may also allow for an increased number of apertures 304 while maintaining separation of the streams. An increased number of separate streams facilitate quicker traversal of the liquid through the liquid-diffusing filter. For example, the increased number of apertures can facilitate a user to pour wine, from a wine bottle, through the liquid-diffusing filter 400 without risk of overflow or spillage.

In some variations, the apertures 304 can be tubes. Having the apertures 304 being tubes can facilitate avoidance of stream diversion as the liquid flows through the apertures 304. In some variations, the tubes can be contracting tubes, whereby the radius of the tube is smaller toward the exit hole 407 compared to the entry hole 402. In some variations, the tubes can have graduating radii. While the term "radius" is used, this is not intended to limit the tubes to being round. The tubes can have any shape, such as irregular or regular polygonal shape, oval, round, or the like.

The liquid-diffusing filter 300 and its components can have any size, in some exemplary embodiments the base plate 303 can have a width in the range of 3 cm to 10 cm, and the apertures 304 of the liquid-diffusing filter 300 can have a width in the range of 0.1 cm to 0.5 cm. In some variations, the apertures 304 can have a height in the range of 0.05 cm to 0.3 cm. In some exemplary embodiments there can be between 6-60 apertures 304.

The liquid-diffusing filter 400 and its components can have any size; in some exemplary embodiments it can have a height between 3 cm to 15 cm and a width of 3 cm to 15 cm. The vessel engagement portion 406 can have a width between 3 cm and 10 cm.

In the embodiment shown, the housing 401 includes inwardly curved sidewalls of varying height to help guide the liquid to the filter 300. The fill hole 402 is shown being angled for ease of pouring wine into the housing 401 from a bottle 412. The higher sidewall portion may also act as a splash shield to prevent the splashing of wine during the initial pour.

Variations, Modifications, and Combinations

Various modifications to the implementations described in this disclosure may be readily apparent to those skilled in the art, and the generic principles defined herein may be applied to other implementations without departing from the spirit or scope of this disclosure. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure. Thus, the disclosure is not intended to be limited to the implementations shown herein, but is to be accorded the widest scope consistent with the principles and features disclosed herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

What is claimed is:

1. A method of aerating a beverage comprising:

providing a liquid-diffusing filter comprising:

a housing having a fill hole and an exit hole;

a vessel engagement portion of the housing that tapers toward the exit hole to retain the liquid-diffusing filter to a vessel;

a base plate configured in the housing and having multiple apertures to form a filter consisting of said base plate;

each of said multiple apertures extending through a separate tube that extends from a base of the base plate to said exit hole;

wherein the separate tubes extend from the base plate a height and wherein the height of the separate tubes from the base is at least 0.05 cm;

wherein each of the exit holes are configured on a bottom of the base plate;

wherein the liquid-diffusing filter is monolithic wherein the housing, vessel engagement portion and base plate are contiguous in construction;

pouring the beverage into the fill hole of the housing;

wherein the beverage flows through the multiple apertures of the filter and through the separate tubes extending from the base of the base plate to form multiple streams of beverage from the filter directly into the vessel;

aerating the beverage by forming said multiple streams of beverage through the multiple apertures to produce an aerated beverage;

wherein the multiple streams of beverage flow from the exit holes as separate streams into said vessel streaming the aerated beverage into the vessel directly from the separate tubes; and removing the liquid-diffusing filter from the vessel.

2. The method of claim 1, wherein the multiple apertures are polygonal apertures.

3. The method of claim 1, wherein the separate tubes are contracting tubes wherein each of the multiple apertures through the separate tubes is smaller proximal to the exit hole than the fill hole.

* * * * *